US005981890A

United States Patent [19]

Chen

[11] Patent Number: 5,981,890

[45] Date of Patent: Nov. 9, 1999

[54] TOUCH-TO-ACTION STRUCTURE OF A KEY SIGNAL

[75] Inventor: Chih Ching Chen, Taipei Hsien, Taiwan

[73] Assignee: Chicony Electronics Co., Ltd., Taipei, Taiwan

[21] Appl. No.: 09/173,031

[22] Filed: Oct. 16, 1998

[51] Int. Cl.[6] ..... H01H 13/70

[52] U.S. Cl. ..... 200/515

[58] Field of Search ..... 200/5 A, 341, 200/512–517, 345; 400/472, 480, 481, 490, 491, 491.1, 491.2

[56] References Cited

U.S. PATENT DOCUMENTS

| | | | |
|---|---|---|---|
| 3,784,768 | 1/1974 | Hunt | 200/52 R |
| 3,995,128 | 11/1976 | Hawkins | 200/5 A |
| 4,485,279 | 11/1984 | Nakamura | 200/5 A |
| 4,916,262 | 4/1990 | Jungels-Butler et al. | 200/5 A |

*Primary Examiner*—Michael Friedhofer
*Attorney, Agent, or Firm*—Rosenberg, Klein & Bilker

[57] ABSTRACT

A touch-to-action structure of a key signal comprises a lower thin film circuit board, an upper thin film circuit board and a spacer. Wires and a plurality of electric connections are formed on the upper surface of the lower thin film circuit board. The upper thin film circuit board are arranged above the lower thin film circuit board, Wires and a plurality of electric connections are formed on the lower surface of the upper thin film circuit board. The spacer is arranged between the upper and lower thin film circuit boards, the spacer being installed with a plurality of vent holes correspondent to the electric connections of the upper and lower thin film circuit boards. At least one vent hole is installed in each outer rim of the electric connections of the upper in film circuit board and the lower thin film circuit board for venting air. As the key is clicked continuously and rapidly, the air still can effectively vented and sucked so that the touch-to-action hat still can operate normally. Therefore, a suction effect is prevented.

3 Claims, 5 Drawing Sheets

TOUCH-TO-ACTION STRUCTURE OF A KEY SIGNAL

BACKGROUND OF THE INVENTION

1. Field of the Invention

The present invention relates to a touch-to-action structure of a key signal, and especially to a thin film wire structure in which as the key is clicked continuously and rapidly, a touch-to-action hat still can operate normally.

2. Background of the Invention

Thin film wire structures are widely used in the prior art touch-to-action structure of a key signal, such as Taiwan Patent Publication Nos. 237991, 303975, 314250, 325162, etc. The prior art touch-to-action structure of a key signal (thin film wire) includes a lower thin film circuit board, an upper thin film circuit board and a spacer. The lower thin film circuit board is installed with wires and electric connections above the upper thin film circuit board The upper thin film circuit board is arranged on the lower thin film circuit board. The upper thin film circuit board is installed with wires and a plurality of electric connections which are arranged on the upper surface of the lower thin film circuit board and are correspondent to the electric connections of the lower thin film circuit board The spacer is arranged between the upper and lower thin film circuit boards, the spacer is installed with a plurality of vent holes correspondent to the electric connections of the lower thin film circuit boards and the upper thin film circuit board. When the key is clicked, the electric connections of the upper thin film circuit board and the electric connections of the lower thin film circuit board are actuated so to form an electric contact When the key is released, the key can be restored to the original position by the elasticity of a touch-to-action hat.

However, in the prior art, as the key is clicked continuously and rapidly, the air often can not be effectively vented and sucked so that the touch-to-action hat will riot be operated normally by a suction effect.

SUMMARY OF THE INVENTION

Accordingly, a touch-to-action structure of a key signal comprises a lower thin film circuit board, an upper thin film circuit board and a spacer. The upper thin film circuit board is arranged above the lower thin film circuit board. The spacer is arranged between the upper and lower thin film circuit boards. Characterized in that at least ore vent hole is installed in each outer rim of the electric connections of the upper thin film circuit board and the lower thin film circuit board for venting air. As the key is clicked continuously and rapidly, the air still can effectively vented and sucked so that the touch-to-action hat still can operate normally. Therefore, a suction effect is prevented.

The present invention will be better understood and its numerous objects and advantages will become apparent to those skilled in the art by referencing to the following drawings in which:

DETAILED DESCRIPTION OF THE PREFERRED EMBODIMENT

Figure 1:
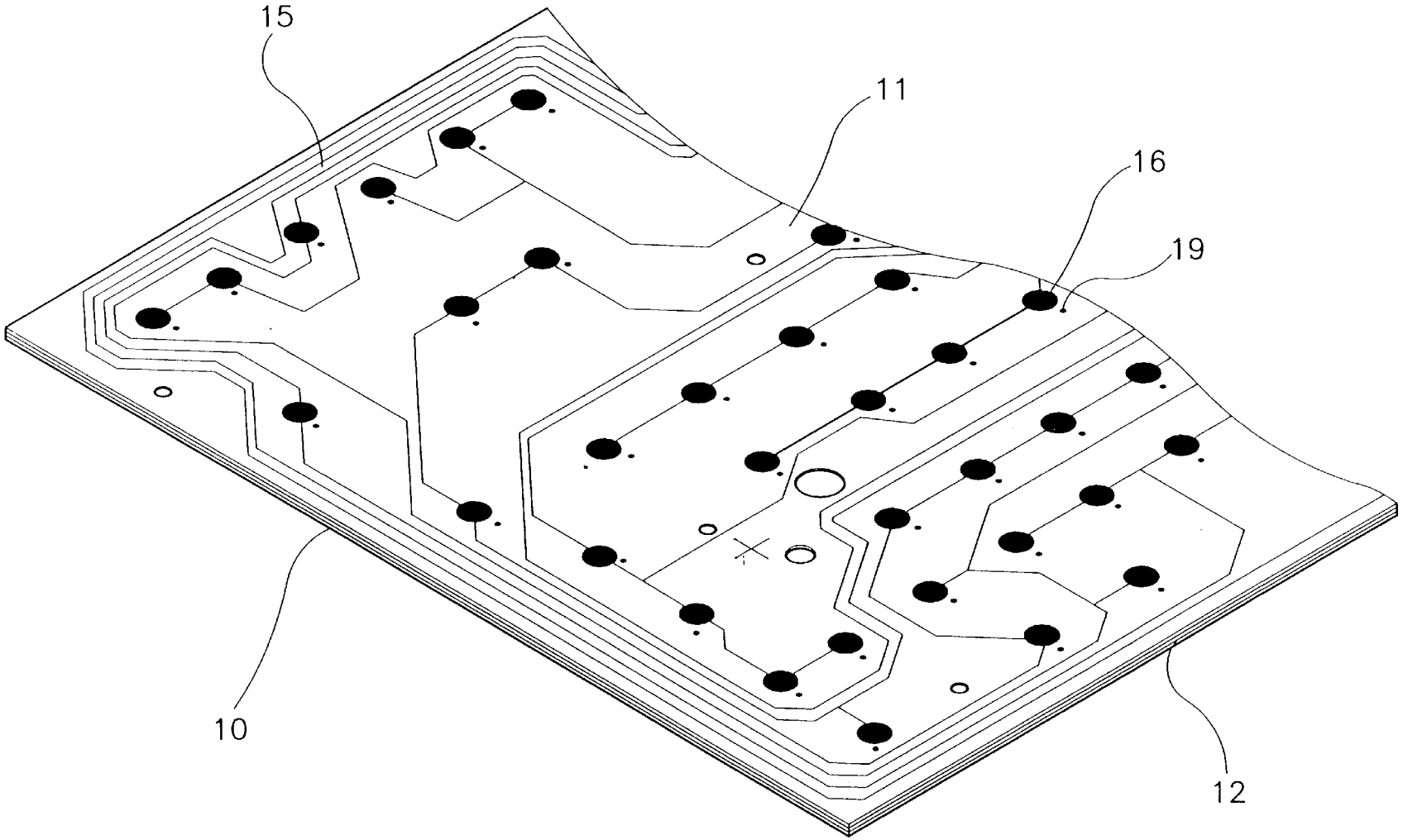
FIG. 1 is a perspective view of the present invention.
Figure 2:
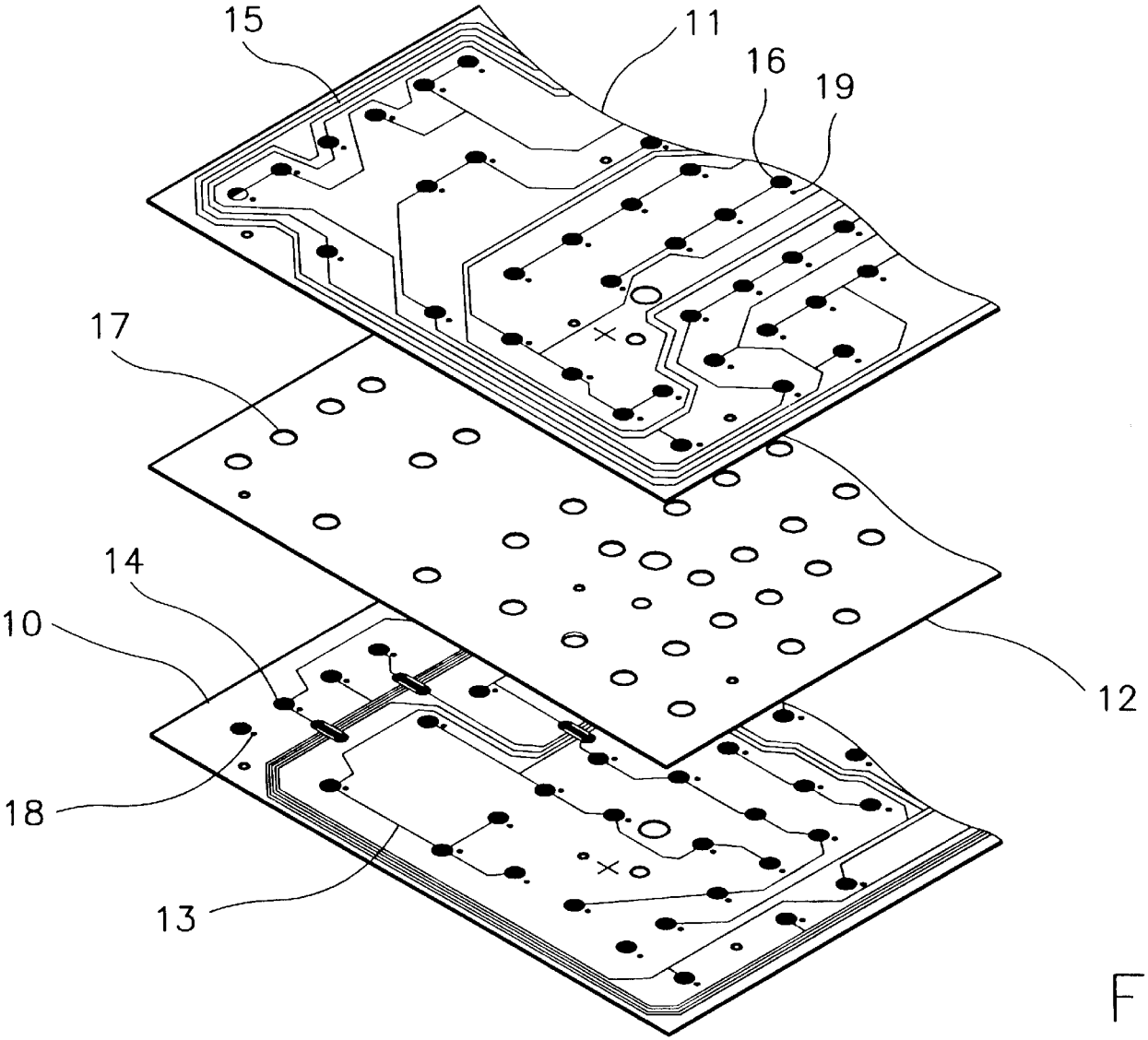
FIG. 2 is an exploded view of the present invention.
Figure 3:
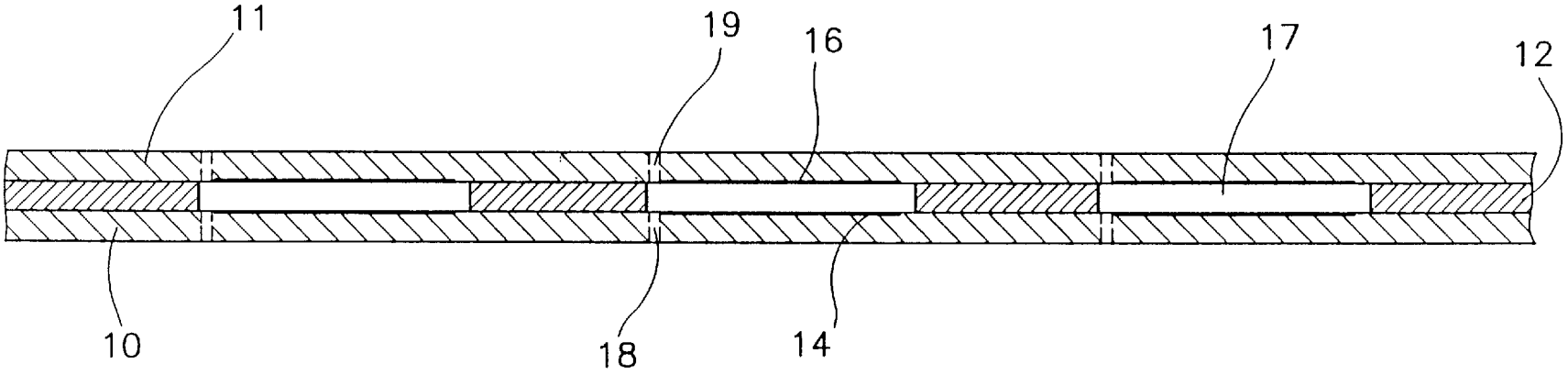
FIG. 3 is a plane cross sectional view of the present invention.

As shown in FIGS. 1, 2 and 3, the touch-to-action structure of a key signal of the present invention is a in film unit and includes a lower thin film circuit board 10, an upper thin film circuit board 11 and a spacer 12. The lower thin film circuit board 10 and the upper thin film circuit board 11 are formed by transparent thin film. Wires 13 are layout on the lower thin film circuit board 10. The wires 13 have a plurality of electric connections 14. The positions of the electric connections 14 are correspondent to the keys on the keyboard.

The upper thin film circuit board 11 is arranged on the lower thin fin circuit board 10. Wires 15 are layout on the lower surface of the upper thin film circuit board 11. A plurality of electric connections 16 are formed on the wires 15. The positions of the electric connections 16 are correspondent to the electric connections 14 on the upper surface of the lower thin film circuit board 10.

Spacer 12 is arranged between the lower thin film circuit board 10 and upper thin film circuit board 11 for preventing contact occurring between the wires 13 of the lower thin film circuit board 10 and the wires 15 of the upper thin film circuit board 11. Furthermore, a plurality of through holes 17 are installed on the spacer 12. These Through holes 17 is correspondent to the electric connections 14 and 16 of the lower thin film circuit board 10 and the upper thin film circuit board 11, respectively.

In the present invention, at least one vent hole 18 is formed on the edge of the electric connections 14 of the lower tin film circuit board 10, or each of the outer wires of the electric connections 14 of the lower thin film circuit board 10 is installed with at least one vent hole 19, or each of the outer wires of the electric connections 14 of the lower thin film circuit board 10 and the electric connections 16 of the upper thin film circuit board 11 are installed with at least one vent hole, 18 and 19, respectively. The vent holes 18 and 19 can be selectively installed on the lower thin film circuit board 10 and/or the upper thin film circuit board 11 independents.

Figure 4:
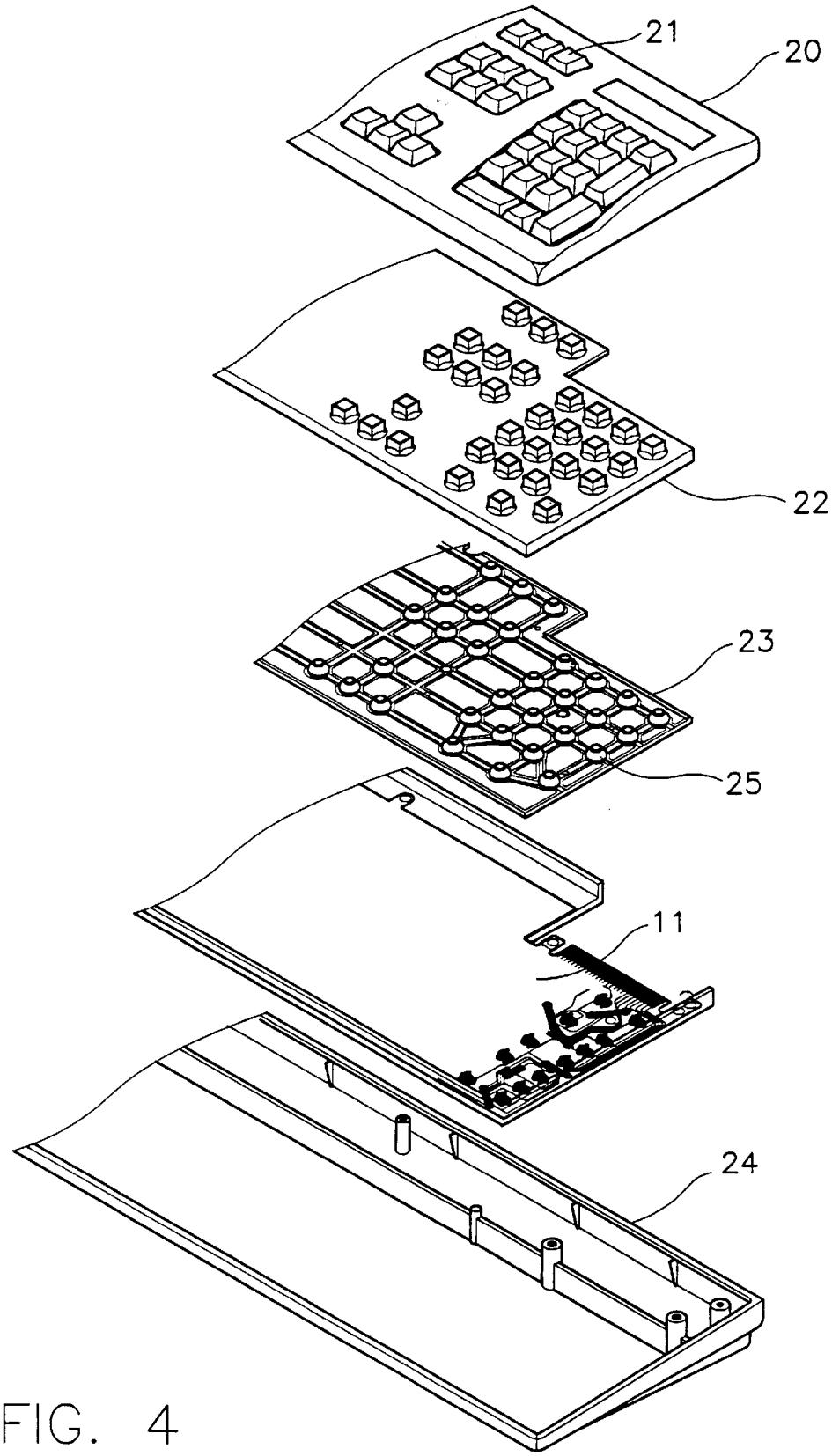
FIG. 4 is a schematic perspective view showing that the present invention is assembled to a keyboard.
Figure 5:
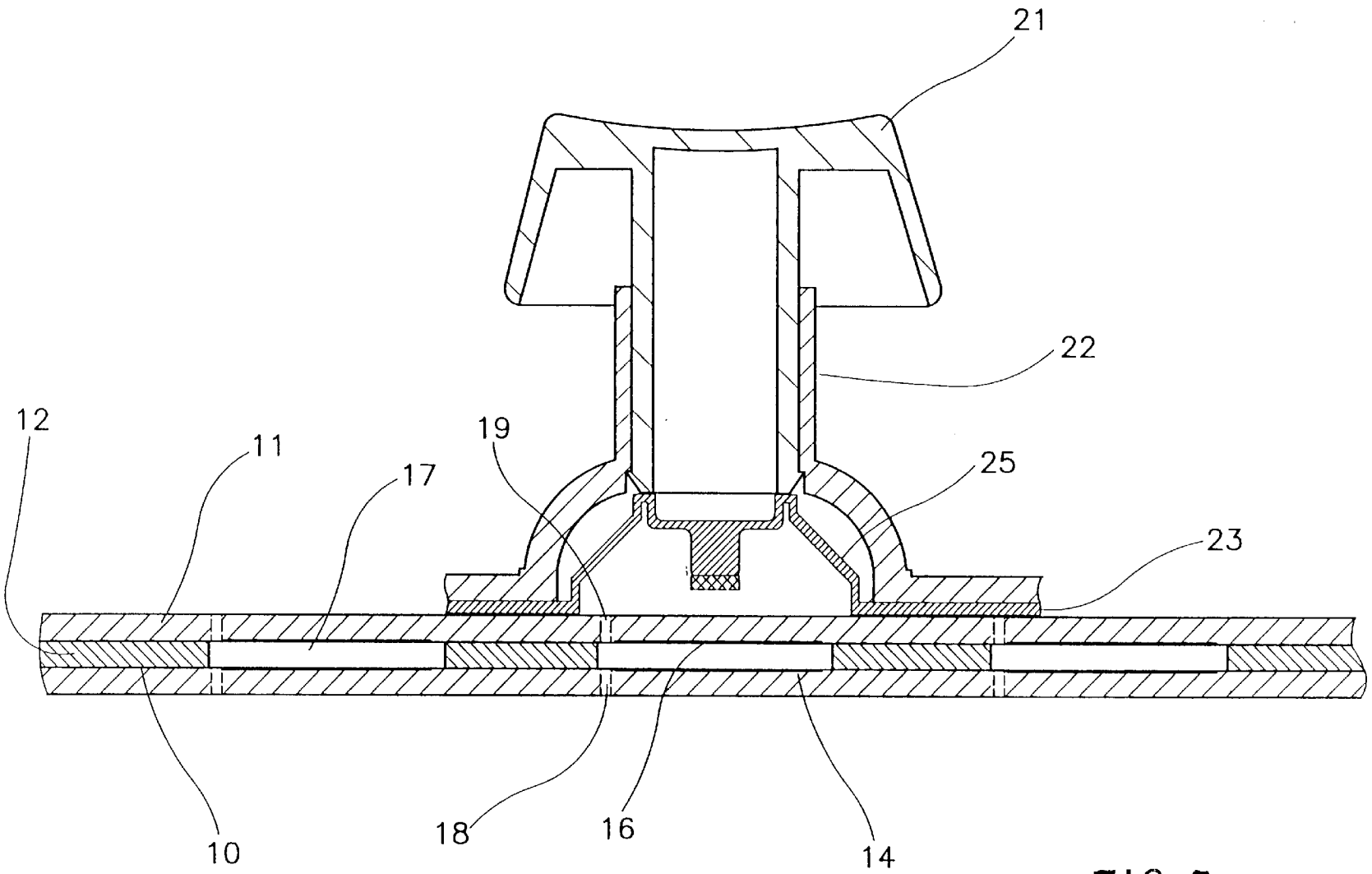
FIG. 5 is a schematic view showing the using state of the present invention.

As shown in FIGS. 4 and 5, the assembly of the key signal touch-to-action structure of the present invention is similar to that of the prior art. Wherein the keyboard includes an upper cover 20, a key 21, a medium plate 22, a rubber elastic body 23, a seat 24, etc. which are installed and locked in a order. The rubber elastic body 23 is installed between the key 21 and the key signal touch-to-action structure. The tops of all conductive touch-to-action hats 25 are contacted with the key 21. When the key 21 is clicked, it presses the touch-to-action hat 25 so that the touch-to-action hat 25 will be pressed so to actuate the electric connections 16 of the upper thin film circuit board 11 and the electric connections 14 of the lower thin film circuit board 10 to conduct the circuit board and then form an electric contact. If the key 21 is released, then by the elasticity of the touch-to-action hat 25, the key 21 can be restored to the original position. Since the lower thin film circuit board 10 and/or the lower thin film circuit board 11 are installed with vent 18 and/or 19, they have the effect of venting air. Thus, even the key 21 is pressed continuously and rapidly, the air still can be vented and sucked. Thus, the touch-to-action hat can completely prevent the action of a suction disk and thus can be operated normally.

In summary, in the present invention, the prior art key signal touch-to-action structure is improved In the prior art, as the key is clicked continuously and rapidly, the air often can not be effectively vented and sucked so that the touch-to-action hat will not be operated normally. However, by the present invention, the disadvantages in the prior art are improved.

Although the invention has been described in detail with reference only to a preferred embodiment, those skilled in the art will appreciate hat various modifications can be made without departing from the invention. Accordingly, the invention is defined only by the following claims which are intended to embrace all equivalent thereof.

Description of the Numerals in Figures.

| | |
|---|---|
| 10 lower thin film circuit board | 11 upper thin film circuit board |
| 12 spacer | 13 wire |
| 14 electric connection | 15 wire |
| 16 electric connection | 17 through hole |
| 18 vent hole | 19 vent hole |
| 20 upper cover | 21 key |
| 22 medium plate | 23 rubber elastic body |
| 24 base | 25 touch-to-action hat |

What is claimed is:

1. A touch-to-action keyboard structure, comprising:

a lower thin film circuit layer having a plurality of first electrically conductive sites formed on an upper surface thereof;

an upper thin film circuit layer spaced above said lower thin film circuit layer and having a plurality of second electrically conductive sites formed on a lower surface thereof in aligned relationship with said first electrically conductive sites, said upper thin film circuit layer having a plurality of vent holes formed therethrough, each of said vent holes being disposed adjacent a respective of said second electrically conductive sites;

a spacer member disposed between said lower and upper thin film circuit layers and having a plurality of openings formed therethrough in aligned relationship with said first and second electrically conductive sites to define respective switch locations, each of said openings encompassing respective ones of said first and second electrically conductive sites and a respective vent hole; and, means for displacing a select ed one of said plurality of second electrically conductive sites through a respective one of said spacer openings to contact a corresponding one of said first electrically conductive sites, whereby each of said switch locations are coupled in fluid communication with a respective one of said plurality of vent holes to enable rapid displacement of each of said plurality of second electrically conductive sites.

2. A touch-to-action keyboard structure, comprising:

a lower thin film circuit layer having a plurality of first electrically conductive sites formed on an upper surface thereof, said lower thin film circuit layer having a plurality of vent holes formed therethrough, each of said vent holes being disposed adjacent a respective of said first electrically conductive sites;

an upper thin film circuit layer spaced above said lower thin film circuit layer and having a plurality of second electrically conductive sites formed on a lower surface thereof in aligned relationship with said first electrically conductive sites;

a spacer member disposed between said lower and upper thin film circuit layers and having a plurality of openings formed therethrough in aligned relationship with said first and second electrically conductive sites to define respective switch locations, each of said openings encompassing respective ones of said first and second electrically conductive sites and a respective vent hole; and, means for displacing a selected one of said plurality of second electrically conductive sites through a respective one of said spacer openings to contact a corresponding one of said first electrically conductive sites, whereby each of said switch locations are coupled in fluid communication with a respective one of said plurality of vent holes to enable rapid displacement of each of said plurality of second electrically conductive sites.

3. A touch-to-action keyboard structure, comprising:

a lower thin film circuit layer having a plurality of first electrically conductive sites formed on an upper surface thereof, said lower thin film circuit layer having a plurality of first vent holes formed therethrough, each of said first vent holes being disposed adjacent a respective of said first electrically conductive sites;

an upper thin film circuit layer spaced above said lower thin film circuit layer and having a plurality of second electrically conductive sites formed on a lower surface thereof in aligned relationship with said first electrically conductive sites, said upper thin film circuit layer having a plurality of second vent holes formed therethrough, each of said second vent holes being disposed adjacent a respective of said second electrically conductive sites;

a spacer member disposed between said lower and upper thin film circuit layers and having a plurality of openings formed therethrough in aligned relationship with said first and second electrically conductive sites to define respective switch locations, each of said openings encompassing respective ones of said first and second electrically conductive sites and respective first and second vent holes; and, means for displacing a selected one of said plurality of second electrically conductive sites through a respective one of said spacer openings to contact a corresponding one of said first electrically conductive sites, whereby each of said switch locations are coupled in fluid communication with a respective one of said plurality of first vent holes and a respective one of said plurality of second vent holes to enable rapid displacement of each of said plurality of second electrically conductive sites.

* * * * *